US006500593B2

(12) United States Patent
Abe et al.

(10) Patent No.: US 6,500,593 B2
(45) Date of Patent: Dec. 31, 2002

(54) TONER, AND TONER PRODUCTION PROCESS

(75) Inventors: Koji Abe, Shizuoka (JP); Hitoshi Itabashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/995,702

(22) Filed: Nov. 29, 2001

(65) Prior Publication Data

US 2002/0102485 A1 Aug. 1, 2002

(30) Foreign Application Priority Data

Nov. 29, 2000 (JP) ..... 2000-362149
Nov. 5, 2001 (JP) ..... 2001-338837

(51) Int. Cl.[7] ..... G03G 9/00
(52) U.S. Cl. ..... 430/108.22; 430/137.15
(58) Field of Search ..... 430/108.21, 108.22, 430/137.1, 137.15

(56) References Cited

U.S. PATENT DOCUMENTS 2,297,691 A 10/1942 Carlson
4,071,670 A 1/1978 Vanzo et al. ..... 526/88
5,854,331 A * 12/1998 Ma et al. ..... 524/505
5,948,843 A * 9/1999 Boutier et al. ..... 524/313

FOREIGN PATENT DOCUMENTS

| | | |
|---|---|---|
| JP | 36-10231 | 7/1961 |
| JP | 51-14895 | 5/1976 |
| JP | 53-17735 | 2/1978 |
| JP | 53-17736 | 2/1978 |
| JP | 53-17737 | 2/1978 |
| JP | 11-119461 | 4/1999 |

* cited by examiner

*Primary Examiner*—John Goodrow
(74) *Attorney, Agent, or Firm*—Fitzpatrick, Cella, Harper & Scinto

(57) ABSTRACT

In a toner containing at least a binder resin, a pigment and a pigment dispersant, the pigment dispersant has a structure wherein a quinacridone molecular skeleton which is readily adsorptive on the colorant pigment and an oligomer or polymer which has good affinity for the solvent and for the resin serving as a toner binder are covalently bonded. Also disclosed is a process for producing the toner.

18 Claims, No Drawings

TONER, AND TONER PRODUCTION PROCESS

BACKGROUND OF THE INVENTION

1. Field of the Invention

This invention relates to a toner for developing an electrostatic image in an image-forming process such as electrophotography or electrostatic printing, or a process for producing a toner for forming a toner image in a toner-jet type image-forming method. More particularly, this invention relates to a process for producing a toner used in a fixing method in which a toner image formed using the toner is fixed to a transfer medium such as a printing sheet under application of heat and pressure.

2. Related Background Art

In order to render visible an electric or magnetic latent image formed on a recording member, an image-forming method is available in which electroscopic or magnetosensitive fine particles called a toner are attracted to the latent image to form a visible image. It may typically include electrophotography, and a number of methods are known as methods therefor as disclosed in, e.g., U.S. Pat. No. 2,297,691. In this electrophotography, copies are commonly obtained by forming an electrostatic latent image on a photosensitive member by various means, utilizing a photoconductive material, subsequently developing the latent image by the use of a toner to form a toner image, transferring the toner image to a transfer medium such as paper as occasion calls, and thereafter fixing the toner image to the transfer medium by the action of heat, pressure or solvent vapor.

In recent years, the above technique has become used in output means, i.e., what is called printers, of computers, word processors and so forth because of its high image quality and stillness. Usually, toners used in printers and copying machines are fine particles composed chiefly of a resin, a colorant such as a magnetic material, carbon black, a dye or a pigment and a wax, and have particle diameters usually ranging from 6 to 30 $\mu$m. Toners are commonly produced by mixing and melting a colorant comprising a dye or pigment or a magnetic material in a thermoplastic resin to disperse the colorant uniformly therein, followed by fine pulverization and classification to obtain toners having a desired particle diameter. This method is stable as a technique, and enables relatively easy management of materials and production steps.

Meanwhile, a method of producing a toner by polymerization, in particular, a method of producing a toner by what is called suspension polymerization is proposed. Such a method is disclosed in, e.g., Japanese Patent Publication Nos. 36-10231 and 51-14895 and Japanese Patent Application Laid-Open Nos. 53-17735, 53-17736 and 53-17737. This method is a method in which a binder resin and materials to be incorporated in the toner, including a colorant such as a dye or a pigment (e.g., a magnetic material or carbon block), a charge control agent, and a release agent such as wax or silicone oil, are dissolved or dispersed in a polymerizable monomer optionally together with a polymerization initiator and a dispersant to prepare a polymerizable composition, which is then dispersed in an aqueous continuous phase containing a dispersion stabilizer by means of a dispersion apparatus to form a dispersion of fine particles, and this dispersion is polymerized and then solidified to obtain toner particles having any desired particle diameter and composition. This method has no pulverization step, and is expected to bring about the effect of energy saving, improvement in process yield and cost reduction.

As a method of improving print quality, studies are energetically made on a technique by which the latent image can faithfully be reproduced by making the particle diameter of the toner smaller. However, making the particle diameter smaller makes the quantity of toner per unit are smaller, and hence the coloring power per unit volume of the toner must be made higher in order to attain the desired image density. As a means therefor, it is common to use a means by which the colorant dye or pigment is introduced in a larger quantity. There, however, is a problem that pigments, in particular quinacridone pigments, used as colorants of toners are no expensive as to result in an increase in the production cost. Accordingly, in order to make the coloring power of dyes and pigments themselves higher and improve the transparency of OHP images, studies are energetically made on how the dispersion of dyes and pigments in the interior of toner particles be improved.

In order to improve the dispersion of dyes and pigments, it is commonly important to make the dyes and pigments readily compatible with resins. Accordingly, the dyes and pigments are subjected to surface treatment. Proposals on the surface treatment of dyes and pigments to improve their dispersibility are disclosed in Japanese Patent Application Laid-open No. 11-119461, Japanese Patent No. 2800558 and so forth. There, however, has been room for improvement with regard to the dispersibility of pigments.

In the case of pulverization toners, the surface treatment of dyes and pigments must be regulated in conformity with the composition of binder resins, and there has been a problem that any good state of dispersion can not be attained if the matching of the both is improper.

In the case of polymerization toners, the surface treatment of dyes and pigments is made in many cases, most of which, however, is to make hydrophobic treatment with silane coupling agents or to make a pigment dispersant (which is a polymer having a polar group) adsorbed on the particle surfaces of a colorant so that the pigment can be prevented from agglomerating.

In the case when such a pigment dispersant is used, the state of dispersion to a certain extent can be achieved. However, the pigment may undergo re-agglomeration in post steps of drying, shaping, polymerization reaction and so forth, or, in the production of polymerization toner in an aqueous medium, the presence of polar groups on the pigment particle surfaces may cause the migration of pigment to toner particle surfaces, resulting in a lowering of charging performance and environmental stability.

SUMMARY OF THE INVENTION

Accordingly, an object of the present invention is to provide a toner having solved the above problems, and a process for producing the toner.

More specifically, an object of the present invention is to provide a toner having superior coloring powder and transparency, and a process for producing such toner.

Another object of the present invention is to provide a toner having a pigment added in a small quantity, and having achieved a cost reduction, and a process for producing such toner.

Still another object of the present invention is to provide a toner which does not cause any migration of pigment to toner particle surfaces and has superior charging performance and environmental stability, and a process for producing such toner.

To achieve the above objects, the present invention provides a toner containing at least a binder resin, a pigment and a pigment dispersant:

the pigment dispersant having a structure represented by the following Formula (1):

(1)

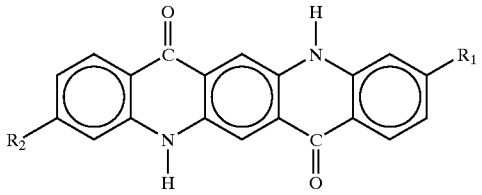

wherein at least one of $R_1$ and $R_2$ is a substituent $X_1$ represented by

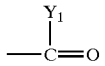

where $Y_1$ is an oligomer or a polymer, and the other is a hydrogen atom.

The present invention also provides a toner containing at least a binder resin, a pigment and a pigment dispersant;

the pigment dispersant having a structure represented by the following Formula (2):

(2)

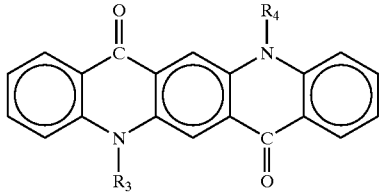

wherein at least one of $R_3$ and $R_4$ is a substituent $X_2$ represented by

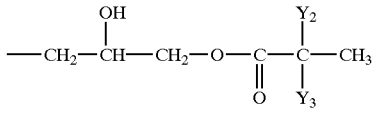

where $Y_3$ and $Y_4$ are each a substituent selected from the group consisting of H, $CH_3$, an oligomer and a polymer, and the other is a hydrogen atom.

The present invention still also provides a process for producing the above toner.

DETAILED DESCRIPTION OF THE PREFERRED EMBODIMENT

The pigment dispersant according to the present invention has a structure wherein a quinacridone molecular skeleton which is readily adsorptive on the colorant pigment and an oligomer or polymer which has good affinity for the solvent and for the resin serving as a toner binder are covalently bonded. Also, in the pigment dispersant according to the present invention, the substituents $X_1$ and $X_2$ have an affinity for the polymerizable monomer used in a pigment dispersion step and for the resin serving as a toner binder, and hence the pigment dispersant may become liberated with difficulty in the polymerizable monomer or in the resin, and can exist stably.

The pigment dispersant that can be used in the present invention has the structure of Formula (1) or (2). In Formula (1) at least one of $R_1$ and $R_2$ is a substituent $X_2$. If the substituent $X_1$ is in a large number, it on the one hand strengthens the affinity for the solvent, but on the other hand may inhibit the adsorptive force to the pigment. Accordingly, it is preferred that one is the substituent $X_1$ and the other is a hydrogen atom. Similarly, in Formula (2), too, at least one of $R_3$ and $R_4$ is a substituent $X_2$, preferably one is the substituent $X_2$, and the other is a hydrogen atom.

The substituent $X_1$ has a substituent $Y_1$, and substituent $X_2$ has substituents $Y_2$ and $Y_3$. The substituents $Y_1$, $Y_2$ and $Y_3$ that can be used in the present invention may be any conventional oligomers or polymers. In particular, a vinyl polymer component containing as a monomer unit a monomer selected from the group consisting of styrene, a styrene derivative, acrylic or methacrylic acid and an acrylic or methacrylic acid derivative, or a polyester component is effective. These substrates are required to have good affinity for the solvent used in a pigment dispersion step and for the resin serving as a toner binder.

The oligomer or polymer constituting the substituents $Y_1$, $Y_2$ and $Y_3$ may specifically include polystyrene, poly-α-methylstyrene, polyacrylate, polymethacrylate, a styrene-acrylate copolymer, a styrene-methacrylate copolymer, a styrene-glycidyl acrylate copolymer, a styrene-glycidyl methacrylate copolymer, and polyester. Also, the substituents $Y_1$, $Y_2$ and $Y_3$ may each preferably have a number-average molecular weight of from 500 to 100,000, and more preferably from 500 to 30,000, and may preferably have a sharp molecular weight distribution, taking account of the solubility in the solvent used in a pigment dispersion step. The molecular weight of the substituents $Y_1$, $Y_2$ and $Y_3$ can be controlled by regulating the molecular weight of the oligomer or polymer used, when the oligomer or polymer is introduced as the substituent into the compound having the quinacridone skeleton.

In the present invention, the pigment dispersant may be used in an amount of from 2 to 100 parts by weight, based on 100 parts by weight of the binder resin. In the case when the toner is produced by polymerization, it may preferably be used in an amount of from 3 to 30 parts by weight.

In the production of the toner of the present invention, known formulation, i.e., a pigment, a resin and other additives such as a wax and a charge control agent may be used except that the pigment dispersant of Formula (1) or (2) is contained. As methods for the production, known methods may also be used. Where the toner is produced by pulverization, the pigment dispersant may be mixed together with a binder resin, a pigment and other additives, and the mixture obtained may be melt kneaded under application of heat and mechanical shear force, followed by a polymerization step and a classification step to produce a toner. In the case of the pulverization, the pigment may previously be treated with the pigment dispersant, and the melt kneading may be carried out using such a pigment to produce the toner.

As another method, the toner may also be produced by a polymerization process in which toner particles are directly obtained by polymerizing a polymerizable monomer in an aqueous medium, and the toner may be obtained by suspension polymerization, emulsion polymerization or emulsification agglomeration. In the process for producing the toner by suspension polymerization, the pigment dispersant and optionally the resin may be dissolved into part or the whole of the polymerizable monomer, and pigment powder may be added little by little with stirring to make it fit well to the polymerizable monomer, where mechanical shear force is further applied by means of a dispersion machine such as a ball mill or a paint shaker, a dissolver, an attritor, a sand mill, a high-speed mill to produce a pigment-dispersed paste. The pigment-dispersed paste thus obtained, a polymerization initiator and the remaining polymerizable monomer may be mixed to make up a polymerizable monomer composition, which is then added to an aqueous medium containing a dispersion stabilizer to carry out granulation and then polymerization to obtain toner particles. In the case of polymerization, the pigment and the pigment dispersant may separately be added and then mixed when the polymerizable monomer composition is prepared.

The polymerizable monomer that can be used when the toner of the present invention is produced by polymerization is an addition polymerization or condensation polymerization type monomer. It may preferably be an addition polymerization type monomer. It may specifically include styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl iodide; vinyl esters such as vinyl acetate, vinyl propionate and vinyl benzoate; α-methylene aliphatic monocarboxylates such as methyl methacrylate, ethyl methacrylate, propyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl other; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic or methacrylic acid derivatives such as acrylonitrile, methacrylonitrile and acrylamide.

The binder resin used when the toner of the present invention is produced by pulverization is selected chiefly taking account of the affinity for the substituent $X_1$ or $X_2$. For example, if may include polystyrene, poly-α-methylstyrene, polyacrylic acid, polymethacrylic acid, polyacrylate, polymethacrylate, a styrene-acrylate copolymer, a styrene-methacrylate copolymer, and polyester.

As the pigment that can be used in the present invention, any known pigments may be used. In particular, color pigments such as quinacridone pigments, carbon black and phthalocyanine pigments may preferably be used. For example, they may include Pigment Violet 19, Pigment Red 122, Pigment Red 207, Pigment Red 206, Pigment Red 202, Pigment Black 6, Pigment Black 7, Pigment Black 8, Pigment Black 10, Pigment Blue 16, Pigment Blue 15, Pigment Blue 15:1, Pigment Blue 15:2, Pigment Blue 15:3, Pigment Blue 15:4, Pigment Blue 15:5, Pigment Blue 15:6, Pigment Green 7 and Pigment Green 36.

In the present invention, the pigment may preferably be added in an amount of from 3 to 20 parts by weight based on 100 parts by weight of the binder resin or polymerizable monomer.

The polymerization initiator used in the production process for the toner of the present invention may include known polymerization initiator. Stated specifically, it may include azo compounds such as 2,2'-azobisisobutyonitrile, 2,2'-azobis-(2,4-dimethylvaleronitrile), 2,2'-azobis(2-methylbutyronitrile, 1,1'-azobis-(cyclohexane-1-carbonitrile), dimethyl-2,2'-azobisisobutyrate, 4,4'-azobis-4-cyanovaleric acid, and 2,2'-azobis(4-methoxy-2,4-dimethylvaleronitrile); peroxides such as benzoyl peroxide, and methyl ethyl ketone peroxide; nucleophilic reagents such as alkali metals, metal hydroxides and Grignard reagents; and protonic acid, metal halides and stabilized carbonium ions. The polymerization initiator may preferably be in a concentration of from 0.1 to 20% by weight, and more preferably from 0.1 to 10% by weight, based on the weight of the polymerizable monomer.

In the case when the toner of the present invention is produced by polymerization, a chain transfer agent may be used, which may include known chain transfer agents.

In the present invention, toner additives as shown below may further be used in order to provide the toner with various properties.

In order to stabilize triboelectric charging performance of the toner, a charge control agent may be incorporated in the toner. In this case, it is preferable to use a charge control agent having a high toner charging speed and capable of maintaining a constant charge quantity stably. When the polymerization method is used to produce the toner particles, charge control agents having no polymerization inhibitory action are particularly preferred. Stated specifically, as negative charge control agents, preferred are metal compounds of salicylic acid, alkyl salicylic acids, dialkyl salicylic acids, naphthoic acid or dicarboxylic acids, polymer type compounds having sulfonic acid or carboxylic acid in the side chain, boron compounds, urea compounds, silicon compounds and carixarene. As positive charge control agents, preferred are quaternary ammonium salts, polymer type compounds having such as quaternary ammonium salt in the side chain, guanidine compounds, and imidazole compounds. Any of these charge control agents may preferably be added in a amount of from 0.5 to 10 parts by weight based on 100 parts by weight of the binder resin.

It is also preferable to add to the toner, external additives such as a fluidity-providing agent, an abrasive, a lubricant and charge controlling particles.

As the fluidity-providing agent, metal oxides such as silicon oxide, aluminum oxide and titanium oxide may preferably be used. These may more preferably these having been subjected to hydrophobic treatment. As the abrasive, metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate may preferably be used. As the lubricant, fluorine resin powders such as vinylidene fluoride and polytetrafluoroethylene, and fatty acid metal salts such as zinc stearate and calcium stearate may preferably be used. As the charge controlling particles, metal oxides such as tin oxide, titanium oxide, zinc oxide, silicon oxide and aluminum oxide, and carbon black may preferably be used.

Any of these external additives may be used in an amount of from 0.1 part to 10 parts by weight, and preferably from 0.1 part to 5 parts by weight, based on 100 parts by weight of the toner particles. These additives may be used alone or in combination of two or more types.

The toner of the present invention may be used as a one-component developer, or may be blended with a carrier so as to be used as a two-component developer.

In the present invention, various physical properties are measured in the manner described below.

Molecular Weight Distribution

The molecular weight distribution of the resin component contained in the toner of the present invention and that of the polymer composition (resin component) soluble in the polymerizing solvent used in the present invention are measured with a GPC measuring instrument (HLC-8120GPC, manufactured by Toso Co.) under the following conditions.

Measuring conditions:

Columns: TSKgelHM-M (6.0 mm in diameter×15 cm), combination of two columns.

Temperature: 40° C.

Flow rate: 0.6 ml/min.

Detector: RI.

Sample concentration: 1.0 μl of 0.1% sample.

To prepare the sample, the sample to be measured is put in THF (tetrahydrofuran), which is then left for several hours, followed by thorough shaking (until no coalesced matter comes to be seen), and the mixture is further left to stand still for 12 hours. Then, the mixture is passed through a sample-treating filter (pore size of 0.45 μm), and the resultant filtrate is used as the sample for GPC measurement. As a calibration curve, a molecular weight calibration curve prepared from a monodisperse polystyrene standard sample is used.

Measurement of Triboelectric Charge Quantity

The toner and the carrier are blended in a suitable blend quantity (2 to 15% by weight) when a developer is produced, and are blended with a Turbra mixer for 180 seconds, and this blended powder (developer) is put in a container made of a metal at the bottom of which a conductive screen with an opening of 20 μm (635 meshes) is provided, and then sucked by means of a suction device. The triboelectric charge quantity is determined from the difference in weight before and after the suction and from the potential accumulated in a capacitor connected to the container. Here, suction pressure is set at 250 mmHg. By this method, the triboelectric charge quantity (Q) is calculated according to the following expression.

$$Q(\mu C/g)=(C\times V)/(W1-W2)$$

wherein W1 is the weight before suction, W2 is the weight after suction, C is the capacity of the capacitor, and V is the potential accumulated in the capacitor.

Measurement of Toner Particle Diameter

To 100 to 150 ml of an electrolytic solution, 0.1 to 5 ml of a surface active agent (alkylbenzene sulfonate) is added, and 2 to 20 mg of the sample to be measured is added thereto. The electrolytic solution in which the sample has been suspended is subjected to dispersion for about 1 minute to about 3 minutes by means of an ultrasonic dispersion machine. Particle size distribution of toner particles of 2 to 40 μm diameters is measured on the basis of volume, by means of Coulter Counter Multisizer, using an aperture of 100 μm. Number-average particle diameter and weight-average particle diameter measured are calculated from the results obtained.

EXAMPLES

The present invention is described below by giving Examples. The present invention is by no means limited by these Examples. In the following, "part(s)" used in Examples all indicates "parts(s) by weight".

Pigment Dispersant

Production Example 1-1

An acid-polystyrene modified quinacridone (Formula 1-(1)) was synthesized in the following way.

(1) Synthesis of 2-carboxyquinacridone;

4.56 parts (0.020 mol part) of dimethyl 1,4-cyclohexanedione-2,5-dicarboxylate, 3.78 parts (0.025 mol part) of methyl 4-aminobenzoate, 2.33 parts (0.025 mol part) of aniline, 50 parts of methanol and 0.47 part of concentrated hydrochloric acid were introduced into a 100 ml reaction vessel, and were reacted at 50° C. for 5 hours. The reaction mixture formed was cooled to room temperature, and 1.8 parts of an aqueous 10% NaOH solution was added thereto, followed by stirring for 10 minutes. The crystals formed were filtered, and then washed with hot methanol. The resultant crystals were dried, and thereafter purified through silica gel columns to obtain a compound of the following formula (1-a). The structure of the formula (1-a) was identified by nuclear magnetic resonance spectroscopy, IR (infrared) spectroscopy, elementary analysis and mass spectrometry.

(1-a)

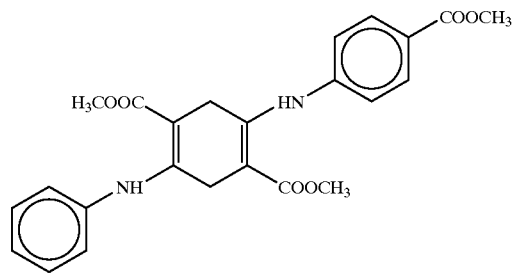

1.0 part (0.0023 mol part) of the compound represented by the formula (1-a), 7.7 parts of ethanol, 1.24 parts (0.0188 mol part) of 85% KOH, 3.73 parts of water and 0.92 part of sodium m-nitrobenzenesulfonate were introduced into a 30 ml reaction vessel, and were heat refluxed for 20 hours. From the reaction mixture formed, the solvent was removed, and 20 ml of water was added to the residue to effect filtration. The filtrate obtained was introduced into a 50 ml reaction vessel, followed by heating to 80° C. To the resultant mixture, 5.36 parts of 10% hydrochloric acid was added, followed by stirring at 80° C. for 18 hours.

The crystals precipitated were filtered, and thereafter the crystals were washed twice with hot water, followed by drying to obtain a compound of the following formula (1-b). The structure of the formula (1-b) was identified by nuclear magnetic resonance spectroscopy, IR spectroscopy, elementary analysis and mass spectrometry.

(1-b)

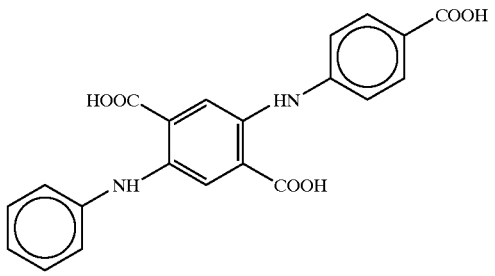

0.39 part (0.000995 mol part) of the compound of the formula (1-b) and 4 parts of polyphosphoric acid were introduced into a 10 ml reaction vessel, and were reacted at 110° C. for 22 hours. The reaction mixture formed was poured into water, and the crystals precipitated were filtered, followed by washing with water and then drying to obtain a carboxylated quinacridone of the following formula (1-c). The structure of the formula (1-c) was identified by nuclear magnetic resonance spectroscopy, IR spectroscopy, elementary analysis and mass spectrometry.

(1-c)

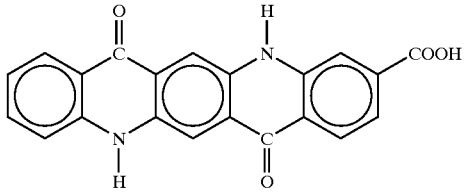

(3) Synthesis of acid chlorinated quinacridone derivative:

4.0 parts of the carboxylated quinacridone (formula (1-c)), 40 ml of toluene and 12 ml of thionyl chloride were introduced into a reaction vessel, and subsequently 0.2 ml of pyridine was added thereto, which were then refluxed for 10 hours. The reaction product formed was concentrated by means of an evaporator to obtain an acid chlorinated quinacridone.

(4) Synthesis of acid-polystyrene modified quinacridone:

25 parts of polystyrene (Mn: 4,120; Mw: 5,022), 80 ml of nitrobenzene and 8.0 parts of aluminum chloride were introduced into a reaction vessel, and were stirred at room temperature for 4 hours, and thereafter 4.0 parts of the acid chlorinated quinacridone was added thereto, which were then stirred at room temperature for 6 hours. The reaction product formed was diluted with 100 ml of THF, and thereafter dropwise added to 2 liters of methanol to effect reprecipitation purification. Washing with methanol and filtration were further repeated, followed by drying under reduced pressure at room temperature for 12 hours to obtain an acid-polystyrene modified quinacridone of the following Formula 1-(1). As a result of IR spectroscopy, elementary analysis and measurement of molecular weight of this final product, it was ascertained that the quinacridone had been modified with acid-polystyrene by one radical (acid-polystyrene) per one quinacridone skeleton.

1-(1)

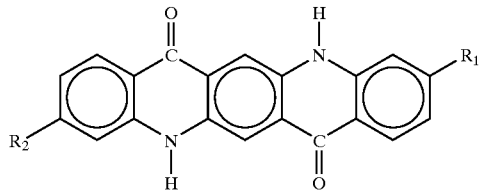

($R_1$: substituent $X_1$; $R_2$: hydrogen; $Y_1$: polystyrene in

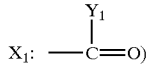

Pigment Dispersant

Production Example 1-2

The following pigment dispersant 1-(2) was produced in the same manner as the production of the pigment dispersant 1-(1) except that the polystyrene used in the modification was changed to one having molecular weight of Mn: 20,100 and Mw: 81,800.

1-(2)

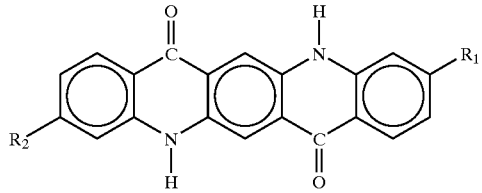

($R_1$: substituent $X_1$; $R_2$: hydrogen; $Y_1$: polystyrene in

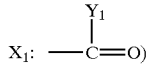

Pigment Dispersant

Production Example 1-3

The following pigment dispersant 1-(3) was produced in the same manner as the production of the pigment dispersant 1-(1) except that the polystyrene used in the modification was changed to a styrene-n-butyl acrylation copolymer (ST/BA: 80/20; Mn: 3,762; Mw: 2,743).

1-(3)

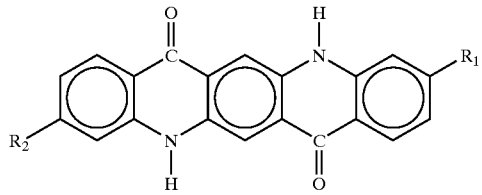

($R_1$: substituent $X_1$; $R_2$: hydrogen; $Y_1$: styrene-n-butyl acrylate copolymer in

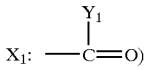

Pigment Dispersant

Production Example 1-4

The following pigment dispersant 1-(4) was produced in the same manner as the production of the pigment dispersant 1-(1) except that the polystyrene used in the modification was changed to one having molecular weight of Mn: 28,200 and Mw: 40,510.

1-(4)

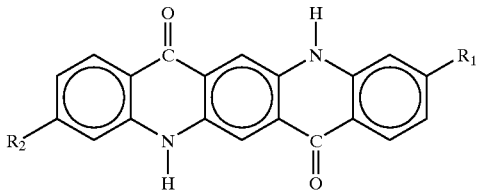

($R_1$: substituent $X_1$; $R_2$: hydrogen; $Y_1$: polystyrene in

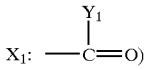

Production of Resin 60 parts of styrene, 25 parts of n-butyl acrylate, 15 parts of monobutyl maleate, 0.5 part of divinylbenzene and 1.2 parts of benzoyl peroxide were mixed to prepare a solution 1, and 0.12 part of polyvinyl alcohol partially saponified product was dissolved in 170 parts of water to prepare a solution 2. The solutions 1 and 2 thus obtained were put together, and stirred vigorously to prepare a suspending dispersion. Next, the suspending dispersion thus obtained was added to a reaction vessel holding 300 parts of water and having been inside displaced with nitrogen to carry out suspension polymerization at a reaction temperature of 75° C. for 8 hours. After the reaction was completed, the reaction product was washed with water and then dehydrated and dried to obtain a resin (1).

Example 1

| | |
|---|---|
| Resin (1) | 100 parts |
| Pigment dispersant 1-(2) | 4 parts |
| Quinacridone (C.I. Pigment Violet 19) | 6 parts |
| Chromium complex (charge control agent) | 4 parts |

The above materials were well mixed using a blender, and thereafter the mixture obtained was kneaded by means of a twin-screw extruder set at 150° C. The kneaded product thus obtained was cooled, and then crushed using a cutter mill. Thereafter the crushed product was finely pulverized by means of a fine-grinding mill making use of jet streams. The resultant finely pulverized product was classified using a fixed-wall type air classifier to produce a classified powder. The classified powder thus obtained was further strictly classified to remove ultrafine powder and coarse powder simultaneously by means of a multi-division classifier utilizing the Coanda effect (Elbo Jet Classifier, manufactured by Nittetsu Kogyo Co.). Thus, a magenta-color toner was obtained.

The particle diameter of the toner obtained was measured with a Coulter counter to reveal that the toner had a weight average particle diameter of 8.4 $\mu$m. The cross sections of toner particles were observed on a transmission electron microscope (TEM) by the dyed ultra-thin slice method. As the result, it was ascertained that pigment particles of about 50 nm in diameter were finely dispersed in the resin layer.

To 100 parts by weight of the toner thus obtained, 0.8 parts of hydrophobic silica powder having a specific surface area of 200 $m^2/g$ as measured by the BET method was externally added. Then, 7 parts of the resultant toner and 93 parts of a ferrite carrier having been surface-coated with a styrene-methyl methacrylate copolymer and having an average particle diameter of 45 $\mu$m were blended to obtain a developer.

The triboelectric charge quantity of 0.1 g of the developer thus obtained was measured in an environment of normal temperature and normal humidity (temperature 25° C./humidity 60% RH) to find that it was −17.4 $\mu$C/g. Using this developer, image reproduction was tested on a remodeled machine of a full-color copying machine CLC-500, manufactured by CANON INC., in the environment of normal temperature and normal humidity. Development was made under conditions of a development contrast of 300 V. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance. Also, images were reproduced on OHP sheets in the same way and were projected on a screen. As the result, highly transparent magenta-color projected images were obtained.

Example 2

| | |
|---|---|
| Resin (1) | 100 parts |
| Quinacridone (C.I. Pigment Violet 19) | 30 parts |
| Pigment dispersant of Formula 1-(2) | 20 parts |

These materials were kneaded by means of a two-roll mill, and the resultant kneaded product was so pulverized as to pass a sieve of 1 mm mesh to obtain a master batch (1).

| | |
|---|---|
| Resin (1) | 80 parts |
| Master batch (1) | 30 parts |
| Chromium complex (charge control agent) | 4 parts |

The above materials were well mixed using a blender in the same manner as in Example 1 and thereafter the mixture obtained was kneaded by means of a twin-screw extruder set at 150° C. The kneaded product thus obtained was cooled, and then crushed, finely pulverized and classified in the same manner as in Example 1 to obtain a magenta-color toner.

The particle diameter of the toner obtained was measured with a Coulter counter to reveal that the toner had a weight average particle diameter of 8.4 μm. The cross sections of toner particles were observed on a transmission electron microscope (TEM) by the dyed ultra-thin slice method. As the result, it was ascertained that pigment particles of about 45 nm in diameter were finely dispersed in the resin layer.

Using the toner thus obtained, a developer was prepared in the same manner as in Example 1, and its triboelectric charge quantity was measured in the same manner as in Example 1 to find that it was −18.6 μC/g. Using this developer, image reproduction was tested on a remodeled machine of a full-color copying machine CLC-500, manufactured by CANON INC., in the same manner as in Example 1. As the result, in every environment, any fog did not occur and changes in image density were small, thus the toner proved to have a good charging performance. Also, images were reproduced on OHP sheets in the same way and were projected on a screen. As the result, highly transparent magenta-color projected images were obtained.

Example 3

| | |
|---|---|
| Styrene monomer | 340 parts |
| Pigment dispersant of Formula 1-(1) | 4 parts |
| Quinacridone (C.I. Pigment Violet 19) | 20 parts |

The above materials were well premixed in a container. Thereafter, keeping the resultant mixture at 20° C. or below, this was dispersed for about 5 hours by means of a bead mill to prepare a pigment-dispersed paste (a). The pigment-dispersed paste (a) thus obtained was uniformly coated on a glass plate using a wire bar. The coating formed was naturally dried and thereafter its glossiness was measured to find that it was 110, showing a good smoothness. Also, a coating formed on aluminum foil in the same way was observed by SEM to find that pigment particles of about 55 nm in diameter were finely dispersed in the coating.

Into 710 parts of ion-exchanged water, 450 parts of an aqueous 0.1 mol/liter $Na_3PO_4$ solution was introduced, and the mixture obtained was heated to 60° C., followed by stirring at 11,000 rpm using TK-type homomixer (manufactured by Tokushu Kika Kogyo). Then, 70 parts of an aqueous 1.0 mol/liter $CaCl_2$ solution was slowly added thereto to obtain a dispersion medium containing $Ca_3(PO_4)_2$.

| | |
|---|---|
| Pigment-dispersed paste (a) | 182 parts |
| 2-Ethylhexyl acrylate | 30 parts |
| Paraffin wax (m.p.: 75° C.) | 60 parts |
| Styrene-methacrylic acid-methyl methacrylate copolymer | 5 parts |
| Di-tert-butylsalicylic acid metal compound | 3 parts |

The above materials were heated to 60° C., and dissolved and dispersed. Keeping the resultant mixture at 60° C., 10 parts by weight of a polymerization initiator 2,2'-azobisisobutyronitrile was further added and dissolved to prepare a polymerizable monomer composition.

This monomer composition was introduced into the dispersion medium prepared in a 2-liter flask of the above homomixer, and then stirred at 10,000 rpm for 20 minutes by means of the TK-type homomixer at 60° C. in an atmosphere of nitrogen to granulate the monomer composition. Thereafter, reaction was carried out at 60° C. for 3 hours with stirring using paddle stirring blades, and thereafter polymerization was carried out at 80° C. for 10 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.2 μm. Toner particle surfaces were observed on a scanning electron microscope (SEM). As the result, any pigment particles were not observed. As a result of further observation by TEM in the same manner as in Example 1, the particles were found to be each separated into a shell composed chiefly of styrene-acrylic resin and a core composed chiefly of wax, thus a capsule structure was ascertained. It was also ascertained that pigment particles of about 55 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −17.6 μC/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance. Also, images were reproduced on OHP sheets in the same way and were projected using an OHP (overhead projector). As the result, highly transparent magenta-color projected images were obtained.

Example 4

| | |
|---|---|
| Styrene monomer | 320 parts |
| n-Butyl acrylate | 80 parts |
| Pigment dispersant of Formula 1-(3) | 4 parts |
| Quinacridone (C.I. Pigment Violet 19) | 20 parts |

The above materials were well premixed in a container. Thereafter, keeping the resultant mixture at 20° C. or below, this was dispersed for about 5 hours by means of a bead mill to prepare a pigment-dispersed paste (b).

The pigment-dispersed paste (b) thus obtained was uniformly coated on a glass plate using a wire bar. The coating formed was naturally dried and thereafter its glossiness was measured to find that it was 112, showing a good smoothness. Also, a coating formed on aluminum foil in the same way was observed by SEM to find that pigment particles of about 55 nm in diameter were finely dispersed in the coating.

| | |
|---|---|
| Pigment-dispersed paste (b) | 212 parts |
| Paraffin wax (m.p.: 75° C.) | 60 parts |
| Styrene-methacrylic acid copolymer (95:5; Mw: 50,000) | 5 parts |
| Di-tert-butylsalicylic acid metal compound | 3 parts |

The above materials were made into a mixture. Keeping the resultant mixture at 60° C., 10 parts by weight of a polymerization initiator 2.2'-azobis(2,4-dimethylvaleronitrile) was further added and dissolved to prepare a monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 1 hour with stirring using paddle stirring blades, and thereafter it was further carried out at 80° C. for 12 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.4 $\mu$m. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained. It was also ascertained that pigment particles of about 55 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −8.4 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidly (30° C./75% RH). As the result, in every environment any fog did not occur and changes in image density were small, thus the toner proved to have a good charging performance. Also, images were reproduced on OHP sheets in the same way and were projected using an OHP. As the result, highly transparent magenta-color projected images were obtained.

Example 5

| | |
|---|---|
| Styrene monomer | 320 parts |
| n-Butyl acrylate | 80 parts |
| Pigment dispersant of Formula 1-(4) | 5 parts |
| Carbon black (Special Black 4, available from Degussa Japan Co., Ltd.) | 20 parts |

The above materials were well premixed in a container. Thereafter, keeping the resultant mixture at 20° C. or below, this was dispersed for about 5 hours by means of a bead mill to prepare a pigment-dispersed paste (c).

The pigment-dispersed paste (c) thus obtained was uniformly coated on a glass plate using a wire bar. The coating formed was naturally dried and thereafter its glossiness was measured to find that it was 115, showing a good smoothness. Also, a coating formed on aluminum foil in the same way was observed by SEM to find that pigment particles of about 30 to 60 nm in diameter were finely dispersed in the coating.

| | |
|---|---|
| Pigment-dispersed paste (c) | 212 parts |
| Paraffin wax (m.p.: 75° C.) | 60 parts |
| Styrene-methacrylic acid copolymer 95:5; Mw: 50,000) | 5 parts |
| Di-tert-butylsalicylic acid metal compound | 3 parts |

The above materials were heated to 60° C., and dissolved and dispersed. Keeping the resultant mixture at 60° C., 10 parts by weight of a polymerization initiator 2,2'-azobis(2,4-dimethylvaleronitrile) was further added and dissolved to prepare a monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 1 hour with stirring using paddle stirring blades and thereafter was further carried out at 80° C. for 12 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.1 $\mu$m. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained. It was also ascertained that pigment particles of about 40 to 60 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −19.8 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance.

Example 6

| | |
|---|---|
| Styrene monomer | 200 parts |
| n-Butyl acrylate | 50 parts |
| Carbon black (Special Black 4, available from Degussa Japan Co., Ltd.) | 12.5 parts |
| Pigment dispersant of Formula 1-(4) | 3.2 parts |

-continued

| | |
|---|---|
| Styrene-methacrylic acid copolymer (95:5; Mw: 50,000) | 6.3 parts |
| Di-tert-butylsalicylic acid metal compound | 3.8 parts |

The above materials were well premixed in a container. Thereafter, keeping the resultant mixture at 20° C. or below, this was dispersed for about 5 hours by means of a bead mill.

220 parts of the dispersion obtained above was heated to 60° C. With stirring, 60 parts of paraffin wax (m.p.:75° C.) and 10 parts by weight of a polymerization initiator 2,2'-azobis(2,4-dimethylvaleronitrile) were further added and dissolved to prepare a monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 1 hour with stirring using paddle stirring blades, and thereafter it was further carried out at 80° C. for 12 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.5 $\mu$m. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained. It was also ascertained that pigment particles of about 40 to 80 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −17.0 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance.

Comparative Example 1

| | |
|---|---|
| Styrene monomer | 320 parts |
| n-Butyl acrylate | 80 parts |
| Quinacridone (C.I. Pigment Violet 19) | 20 parts |

The above materials were well premixed in a container. Thereafter, keeping the resultant mixture at 20° C. or below, this was dispersed for about 5 hours by means of a bead mill to prepare a pigment-dispersed paste (d).

The pigment-dispersed paste (d) thus obtained was uniformly coated on a glass plate in the same manner as in Example 3. The glossiness was measured to find that it was 70, and no smoothness was achievable. Also, a coating formed on aluminum foil in the same way was observed by SEM to find that coarse particles of about 220 nm in diameter and up to fine particles of about 55 nm in diameter were present, showing a great scattering of particle size distribution because of agglomeration of the pigment.

| | |
|---|---|
| Pigment-dispersed paste (d) | 212 parts |
| Paraffin wax (m.p.: 75° C.) | 60 parts |
| Styrene-methacrylic acid copolymer (95:5; MW: 50,000) | 5 parts |
| Di-tert-butylsalicylic acid metal compound | 3 parts |

The above materials were heated to 60° C., and dissolved and dispersed, and a polymerization initiator was further added to prepare a monomer composition. This was granulated and polymerized in the same manner as in Example 3, followed by filtration, water washing, and then drying to obtain a polymerization toner.

The particle diameter of the toner obtained was measured with a Coulter counter to reveal that the toner had a weight average particle diameter of 8.1 $\mu$m. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained, where acicular pigment particles of about 50 to 200 nm in diameter were dispersed in the styrene-acrylic resin layer. Also, many pigment particles were seen to be present at the boundaries between the wax and the styrene-acrylic resin.

Using the toner thus obtained, a developer was prepared in the same manner as in Example 1, and its triboelectric charge quantity was measured in the same manner as in Example 1 to find that it was −20° $\mu$C./g. Using this developer, image reproduction was tested on a remodeled machine of a full-color copying machine CLC-500, manufactured by CANON INC., in the same manner as in Example 1. The images obtained were in an appropriate toner laid-on quantity and in a good fine-line reproduction. In the evaluation also made in an environment of low temperature and low humidity (15° C./15% RH) and an environment of high temperature and high humidity (30° C./75% RH), any fog did not occur in every environment, thus the toner proved to have a good charging performance. However, when images were reproduced on OHP sheets in the same way and were projected using an OHP, projected images having a slightly poor transparency were formed, and chrome was not so high as that in Example 3.

Comparative Example 2

Pigment dispersant (AJISPER PB711, trade name; available from Ajinomoto Co., Inc.; graft polymer obtained by allowing a polyepoxy compound to react with a carboxyl-group-containing linear polymer and an

| | |
|---|---|
| Organic amino compound) | 4 parts |
| Styrene monomer | 320 parts |

-continued

| | |
|---|---|
| n-Butyl acrylate | 80 parts |
| Quinacridone (C.I. Pigment Violet 19:3) | 20 parts |

The above materials were well premixed in a container. Thereafter, keeping the resultant mixture at 20° C. or below, this was dispersed for about 5 hours by means of a bead mill to prepare a pigment-dispersed paste (e).

The pigment-dispersed paste (e) thus obtained was uniformly coated on a glass plate using a wire bar. The coating formed was naturally dried and thereafter its glossiness was measured to find that it was 112, showing a good smoothness. Also, a coating formed on aluminum foil in the same way was observed by SEM to find that pigment particles of about 55 nm in diameter were finely dispersed in the coating.

| | |
|---|---|
| Pigment-dispersed paste (e) | 212 parts |
| Paraffin wax (m.p.: 75° C.) | 60 parts |
| Styrene-methacrylic acid copolymer (95:5; Mw: 50,000) | 5 parts |
| Di-tert-butylsalicylic acid metal compound | 3 parts |

The above materials were heated to 60° C., and dissolved and dispersed, and a polymerization initiator was further added to prepare a monomer composition. This was granulated and polymerized in the same manner as in Example 3, followed by filtration, water washing, and then drying to obtain a polymerization toner.

The particle diameter of the toner obtained was measured with a Coulter counter to reveal that the toner had a weight average particle diameter of 8.1 $\mu$m. Toner particle surfaces were observed with SEM in the same manner as in Example 3. As the result, many pigment particles having a particle diameter of about 55 nm were observable. As a result of further observation of cross sections of particles by TEM in the same manner as in Example 3, the same capsule structure as that in Example 3 was ascertained, where pigment particles of about 50 to 150 nm in diameter were present in the styrene-acrylic resin layer in a little agglomerated state. Also, many pigment particles were seen to be present at the boundaries between the wax and the binder.

Using the toner thus obtained, a developer was prepared in the same manner as in Example 1, and its triboelectric charge quantity was measured in the same manner as in Example 1 to find that it was −12.0 $\mu$C./g. Using this developer, image reproduction was tested on a remodeled machine of a full-color copying machine CLC-500, manufactured by CANON INC., in the same manner as in Example 1. The images obtained were in an appropriate toner laid-on quantity, but fog occurred a little. In the evaluation also made in an environment of high temperature and high humidity (30° C./75% RH), fog was seen to occur more greatly, thus it was ascertained that the toner has environmental properties inferior to the toner of Example 3. Meanwhile, in the image reproduction on OHP sheets, projected images having a transparency slightly inferior to those in Example 3 were formed.

Comparative Example 3

| | |
|---|---|
| Resin (1) | 100 parts |
| Quinacridone (C.I. Pigment Violet 19) | 6 parts |
| Chromium complex (charge control agent) | 4 parts |

The above materials were put to kneading, pulverization and classification in the same manner as in Example 1 to obtain a magenta-color toner.

The particle diameter of the toner obtained was measured with a Coulter counter to reveal that the toner had a weight average particle diameter of 8.1 $\mu$m. The cross sections of toner particles were observed by TEM in the same manner as in Example 1. As the result, pigment particles of about 50 to 200 nm in diameter were seen to be present in the styrene-n-butyl methacrylate resin layer in a little agglomerated state.

Using the toner thus obtained, a developer was prepared in the same manner as in Example 1, and its triboelectric charge quantity was measured in the same manner as in Example 1 to find that it was −16.2 $\mu$C./g. Using this developer and using a remodeled machine of a full-color copying machine CLC-500, manufactured by CANON INC., images were reproduced on OHP sheets in the same manner as in Example 1. As the result, projected images having a transparency slightly inferior to those in Example 1 were formed.

The results of the foregoing Examples and Comparative Examples are shown together in Table 1 below.

TABLE 1

| Production process | Particle diam. of pigment dispersed in toner (nm) | Triboelectric charge quantity ($\mu$C/g) | Charge environmental stability | Fog | Transparency on OHP sheet |
|---|---|---|---|---|---|
| Example: | | | | | |
| 1 Pulverizn | 50 | −17.4 | A | A | A |
| 2 Pulverizn | 45 | −18.6 | A | A | A |
| 3 Polymerizn | 55 | −17.6 | A | A | A |
| 4 Polymerizn | 55 | −18.4 | A | A | A |
| 5 Polymerizn | 40–60 | −19.8 | A | A | A |
| 6 Polymerizn | 40–80 | −17.0 | A | A | A |
| Comparative Example: | | | | | |
| 1 Polymerizn | 50–200 | −20.6 | A | A | C |
| 2 Polymerizn | 50–150 | −12.0 | B | B | B |
| 3 Pulverizn | 50–200 | −16.2 | A | A | B |

The evaluation on the environment stability, fog and transparency shown in Table 1 was made according to the following criteria. Incidentally, the evaluation was made according to the like criteria also in Examples given later.

Environmental stability of charge quantity

Evaluated according to evaluation criteria shown by the following expressions. As samples, those having been left for 24 hours in each environment were used.

A: ((charge quantity in H/H)—(charge quantity in L/L)) <15($\mu$C/g)

B: 15≦((charge quantity in H/H)—(change quantity in L/L)<25)$\mu$C/g)

C: 25≦((charge quantity in H/H)—(charge quantity in L/L)($\mu$C/g) (H/H:high temperature/high humidity environment; L/L:low temperature/low humidity environment)

Fog

Fog density in the high temperature/high humidity environment was measured with Densitometer TC-6DS, manufactured by Tokyo Denshoku K. K. Fog density (%)—(reflection density at fogged areas on transfer paper)—(reflection density of virgin transfer paper)

A:1.0% or less.

B:1.0% to 2.0%.

C:More than 2.0%.

Transparency on OHP sheet

Fixed images on OHP sheets (toner laid-on quantity:0.7 mg/cm$^2$) was projected as transparent images through an overhead projector (OHP; Model 9550, manufactured by 3 M Co.). L* and c* of images projected on a white wall surface were measured with a spectral radiance meter (PR650, manufactured by Photoresearch Co.), and were evaluated as a colorimetric index p= (95-L*)/c* of the projected images.

A:(Good) $0.50 \leqq p < 0.60$.

B:(Passable) $0.60 \leqq p < 0.65$.

C:(Poor) $0.65 \leqq p$.

Pigment Dispersant

Production Example 2-1

A styrene-glycidyl methacrylate copolymer modified quinacridone (Formula 2-(1)) was synthesized in the following way.

0.31 part of quinacridone (C. I. Pigment Violet 19), 0.11 part of potassium tert-butoxide, 5.0 parts of dimethyl sulfoxide, 6.0 parts of a styrene-glycidyl methacrylate copolymer (number-average molecular weight Mn:14,606; weight-average molecular weight Mw:16,700; epoxy equivalent weight:462 g/mol) solution were introduced into a 50 ml reaction vessel, and were reacted at 60° C. for 5 hours in an oil bath. The reaction mixture formed was cooled, and thereafter taken out in a 100 ml beaker, and further a 50 ml reaction vessel was cleaned with 50 ml of xylene, and 2.0 ml of an aqueous 0.5 mol HCl solution was added thereto with stirring. The mixture obtained was dropwise added to 400 ml of methanol to effect reprecipitation purification. This was further washed with 200 ml of water and 200 ml of methanol and filtered, followed by drying under reduced pressure at room temperature for 12 hours to obtain 2.6 parts of a styrene-glycidyl methacrylate copolymer modified quinacridone of the following Formula 2-(1). As a result of IR spectroscopy, elementary analysis and measurement of molecular weight of this final product, it was ascertained that the quinacridone had been modified with styrene-glycidyl methacrylate copolymer by 1.30 radicals (styrene-glycidyl methacrylate copolymer) on the average per one quinacridone skeleton.

2-(1)

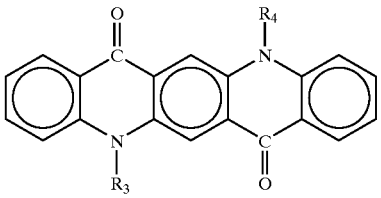

wherein at least one of substituents $R_3$ and $R_4$ was a substituent $X_2$, and, as the whole dispersant, 65% of the total of $R_3$ and $R_4$ was the substituent $X_2$; the remaining was a hydrogen atom, and $Y_2$ and $Y_3$ in the substituent $X_2$ were each the styrene-glycidyl methacrylate copolymer (St/glycidyl methacrylate:80/20)

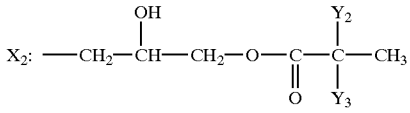

Pigment Dispersant

Production Example 2-2

The following pigment dispersant 2-(2) was produced in the same manner as the production of the pigment dispersant 2-(1) except that production conditions for the styrene-glycidyl methacrylate copolymer were changed and the styrene-glycidyl methacrylate copolymer used in the modification was changed to one having molecular weight of Mn: 30,812 and Mw: 37,051.

2-(2)

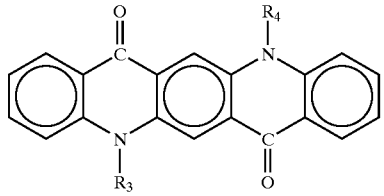

wherein at least one of substituents $R_3$ and $R_4$ was a substituent $X_2$, and, as the whole dispersant, 61% of the total of $R_3$ and $R_4$ was the substituent $X_2$; the remaining was a hydrogen atom, and $Y_2$ and $Y_3$ in the substituent $X_2$ were each the styrene-glycidyl methacrylate (80/20) copolymer

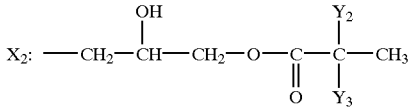

Pigment Dispersant

Production Example 2-3

The following pigment dispersant 2-(3)was produced in the same manner as the production of the pigment dispersant 2-(1) except that production conditions for the styrene-glycidyl methacrylate copolymer were changed and the styrene-glycidyl methacrylate copolymer used in the modification was changed to one having molecular weight of Mn: 16,202 and Mw: 19,244.

2-(3)

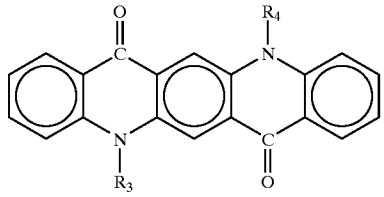

wherein at least one of substituents $R_3$ and $R_4$ was a substituent $X_2$, and, as the whole dispersant, 55% of the total of $R_3$ and $R_4$ was the substituent $X_2$; the remaining was a hydrogen atom, and $Y_2$ and $Y_3$ in the substituent $X_2$ were each the styrene-glycidyl methacrylate (80/20) copolymer

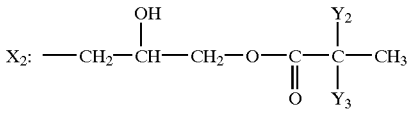

Example 7

| | |
|---|---|
| Resin (1) used in Example 1 | 100 parts |
| Pigment dispersant of Formula 2-(1) | 4 parts |
| Quinacridone (C.I. Pigment Violet 19) | 6 parts |
| Chromium complex (charge control agent) | 4 parts |

The above materials were put to kneading, pulverization and classification in the same manner as in Example 1 to obtain a magenta-color fine resin powder, a toner.

The particle diameter of the toner obtained was measured with a Coulter counter to reveal that the toner had a weight average particle diameter of 8.6 $\mu$m. The cross sections of toner particles were observed on a transmission electron microscope (TEM) by the dyed ultra-thin slice method. As the result, it was ascertained that pigment particles of about 50 nm in diameter were finely dispersed in the resin layer.

Using the toner thus obtained, a developer was prepared in the same manner as in Example 1, and its triboelectric charge quantity was measured in the same manner as in Example 1 to find that it was −18.4 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C. /75% RH). As the result, in every environment any fog did not occur and changes in image density were small, thus the toner proved to have a good charging performance. Also, images were reproduced on OHP sheets in the same way and were projected using an OHP. As the result, highly transparent magenta-color projected images were obtained.

Example 8

| | |
|---|---|
| Resin (1) | 100 parts |
| Quinacridone (C.I. Pigment Violet 19) | 30 parts |
| Pigment dispersant 2-(2) | 20 parts |

These materials were kneaded by means of a two-roll mill, and the resultant kneaded product was so pulverized as to pass a sieve of 1 mm mesh to obtain a master batch (2).

| | |
|---|---|
| Resin (1) | 80 parts |
| Master batch (2) | 30 parts |
| Chromium complex (charge control agent) | 4 parts |

The above materials were well mixed using a blender in the same manner as in Example 1 and thereafter the mixture obtained was kneaded by means of a twin-screw extruder set at 150° C. The kneaded product thus obtained was cooled, and then crushed, finely pulverized and classified in the same manner as in Example 1 to obtain a magenta-color toner.

The particle diameter of the toner obtained was measured with a Coulter counter to reveal that the toner had a weight average particle diameter of 8.1 $\mu$m. The cross sections of toner particles were observed on a transmission electron microscope (TEM) by the dyed ultra-thin slice method. As the result, it was ascertained that pigment particles of about 45 nm in diameter were finely dispersed in the resin layer.

Using the toner thus obtained, a developer was prepared in the same manner as in Example 1, and its triboelectric charge quantity was measured in the same manner as in Example 1 to find that it was −17.6 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C. /75% RH). As the result, in every environment any fog did not occur and changes in image density were small, thus the toner proved to have a good charging performance. Also, images were reproduced on OHP sheets in the same way and were projected using an OHP. As the result, highly transparent magenta-color projected images were obtained.

Example 9

| | |
|---|---|
| Styrene monomer | 340 parts |
| Pigment dispersant of Formula 2-(1) | 4 parts |
| Quinacridone (C.I. Pigment Violet 19) | 20 parts |

The above materials were well premixed in a container. Thereafter, keeping the resultant mixture at 20° C. or below, this was dispersed for about 5 hours by means of a bead mill to prepare a pigment-dispersed paste (f). The pigment-dispersed paste (f) thus obtained was uniformly coated on a glass plate using a wire bar. The coating formed was naturally dried and thereafter its glossiness was measured to find that it was 109, showing a good smoothness. Also, a coating formed on aluminum foil in the same way was observed by SEM to find that pigment particles of about 55 nm in diameter were finely dispersed in the coating.

| | |
|---|---|
| Pigment-dispersed paste (f) | 182 parts |
| 2-Ethylhexyl acrylate | 30 parts |
| Paraffin wax (m.p.: 75° C.) | 60 parts |

-continued

| | |
|---|---|
| Styrene-methacrylic acid-methyl methacrylate copolymer | 5 parts |
| Di-tert-butylsalicylic acid metal compound | 3 parts |

The above materials were heated to 60° C., and dissolved and dispersed. Keeping the resultant mixture at 60° C., 10 parts by weight of a polymerization initiator 2,2'-azobisisobutyronitrile was further added and dissolved to prepare a polymerizable monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 3 hours with stirring using paddle stirring blades, and thereafter polymerization was carried out at 80° C. for 10 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.1 $\mu$m. Toner particle surfaces were observed on a transmission electron microscope (TEM). As the result, any pigment particles were not observed. As a result of further observation by TEM in the same manner as in Example 3, the particles were found to be each separated into a shell composed chiefly of styrene-acrylic resin and a core composed chiefly of wax, thus a capsule structure was ascertained. It was also ascertained that pigment particles of about 55 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −19.8 $\mu$C/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance. Also, images were reproduced on OHP sheets in the same way and were projected using an OHP (overhead projector). As the result, highly transparent magenta-color projected images were obtained.

Example 10

| | |
|---|---|
| Styrene monomer | 320 parts |
| n-Butyl acrylate | 80 parts |
| Pigment dispersant of Formula 2-(3) | 4 parts |
| Quinacridone (C.I. Pigment Violet 19) | 20 parts |

The above materials were well premixed in a container. Thereafter, keeping the resultant mixture at 20° C. or below, this was dispersed for about 5 hours by means of a bead mill to prepare a pigment-dispersed paste (g).

The pigment-dispersed paste (g) thus obtained was uniformly coated on a glass plate using a wire bar. The coating formed was naturally dried and thereafter its glossiness was measured to find that it was 113, showing a good smoothness. Also, a coating formed on aluminum foil in the same way was observed by SEM to find that pigment particles of about 55 nm in diameter were finely dispersed in the coating.

| | |
|---|---|
| Pigment-dispersed paste (g) | 212 parts |
| Paraffin wax (m.p.: 75° C.) | 60 parts |
| Styrene-methacrylic acid copolymer (95:5; Mw: 50,000) | 5 parts |
| Di-tert-butylsalicylic acid metal compound | 3 parts |

The above materials were heated to 60° C., and dissolved and dispersed. Keeping the resultant mixture at 60° C., 10 parts by weight of a polymerization initiator 2,2'-azobis(2,4-dimethylvaleronitrile) was further added and dissolved to prepare a monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 1 hour with stirring using paddle stirring blades, and thereafter further reaction was carried out at 80° C. for 12 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.2 $\mu$m. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained. It was also ascertained that pigment particles of about 55 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −19.0 $\mu$C/g. Using this developer, image reproduction was tested on a remodeled machine of a full-color copying machine CLC-500, manufacture by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance. Also, images were reproduced on OHP sheets in the same way and were projected using an OHP. As the result, highly transparent magenta-color projected images were obtained.

Example 11

| | |
|---|---|
| Styrene monomer | 200 parts |
| n-Butyl acrylate | 50 parts |
| Quinacridone (C.I. Pigment Violet 19) | 12.5 parts |
| Pigment dispersant of Formula 2-(2) | 2.5 parts |
| Styrene-methacrylic acid copolymer (95:5; Mw: 50,000) | 6.3 parts |
| Di-tert-butylsalicylic acid metal compound | 3.8 parts |

The above materials were well premixed in a container. Thereafter, keeping the resultant mixture at 20° C. or below, this was dispersed for about 5 hours by means of a bead mill.

220 parts of the dispersion obtained above was heated to 60° C. With stirring, 60 parts of paraffin wax (m.p.: 75° C.) and 10 parts by weight of a polymerization initiator 2,2'-azobis(2,4-dimethylvaleronitrile) were further added and dissolved to prepare a monomer composition.

This monomer composition was introduced into a dispersion medium prepared in the same manner as in Example 3, and then stirred at 10,000 rpm for 20 minutes by means of the TK-type homomixer at 60° C. in an atmosphere of nitrogen to granulate the monomer composition. Thereafter, reaction was carried out at 60° C. for 1 hour with stirring using paddle stirring blades, and thereafter further reaction was carried out at 80° C. for 12 hours. After the polymerization was completed, the reaction product was cooled, and hydrochloric acid was added to dissolve the $Ca_3(PO_4)_2$, followed by filtration, water washing, and then drying to obtain a polymerization toner.

The particle diameter of the toner obtained was measured with a Coulter counter to reveal that the toner had a weight average particle diameter of 8.5 μm. Toner particle surfaces were observed with SEM in the same manner as in Example 3. As the result, any pigment particles were not observed like Example 3. As a result of further observation of cross sections of particles by TEM in the same manner as in Example 3, the same capsule structure as that in Example 3 was ascertained. It was also ascertained that pigment particles of about 55 to 70 nm in diameter were finely dispersed in the styrene-acrylic resin layer.

Using the toner thus obtained, a developer was prepared in the same manner as in Example 1, and its triboelectric charge quantity was measured in the same manner as in Example 1 to find that it was −20.5 μC/g. Using this developer, image reproduction was tested on a remodeled machine of a full-color copying machine CLC-500, manufactured by CANON INC., in the same manner as in Example 1. The images obtained were in an appropriate toner laid-on quantity, in a high density and in a good fine-line reproduction, thus high-quality images were obtained. The like evaluation was also made in an environment of low temperature and low humidity (15° C./15% RH) and an environment of high temperature and high humidity (30° C./75% RH). As the result, in every environment any fog did not occur and changes in image density were small, thus the toner proved to have a good charging performance.

The results of the foregoing Examples are shown together in Table 2 below.

TABLE 2

| Production process | Particle diam. of pigment dispersed in toner (nm) | Triboelectric charge quantity (μC/g) | Charge environmental stability | Fog | Transparency on OHP sheet |
|---|---|---|---|---|---|
| Example | | | | | |
| 7 Pulverizn | 50 | −18.4 | A | A | A |
| 8 Pulverizn | 45 | −17.6 | A | A | A |
| 9 Polymerizn | 55 | −19.8 | A | A | A |
| 10 Polymerizn | 55 | −19.0 | A | A | A |
| 11 Polymerizn | 55–70 | −20.5 | A | A | A |

What is claimed is:

1. A toner comprising a binder resin, a pigment and a pigment dispersant;

said pigment dispersant having a structure represented by the following Formula (1):

(1)

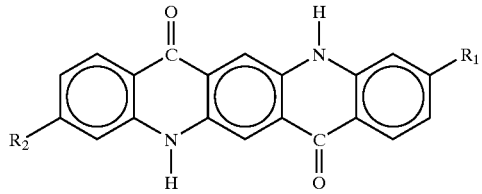

wherein at least one of $R_1$ and $R_2$ is a substituent $X_1$ represented by

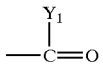

where $Y_1$ is an oligomer or a polymer, and the other is a hydrogen atom.

2. The toner according to claim 1, wherein the substituent $Y_1$ of said pigment dispersant is a vinyl polymer component containing as a monomer unit a monomer selected from the group consisting of styrene, a styrene derivative, acrylic or methacrylic acid and an acrylic or methacrylic acid derivative, or a polyester component.

3. The toner according to claim 1, wherein said pigment dispersant is contained in an amount of from 2 parts by weight to 100 parts by weight based on 100 parts by weight of the pigment.

4. A process for producing a toner comprising melt-kneading a mixture containing at least a binder resin, a pigment and a pigment dispersant, and pulverizing the kneaded product obtained, followed by classification to produce a toner;

said pigment dispersant having a structure represented by the following Formula (1):

(1)

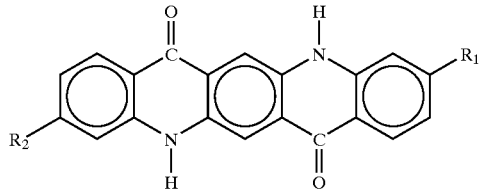

wherein at least one of $R_1$ and $R_2$ is a substituent $X_1$ represented by

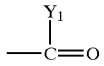

where $Y_1$ is an oligomer or a polymer, and the other is a hydrogen atom.

5. A process for producing a toner comprising melt-kneading a mixture containing at least a binder resin and a pigment having been treated with a pigment dispersant, and pulverizing the kneaded product obtained, followed by classification to produce a toner;

said pigment dispersant having a structure represented by the following Formula (1):

(1)

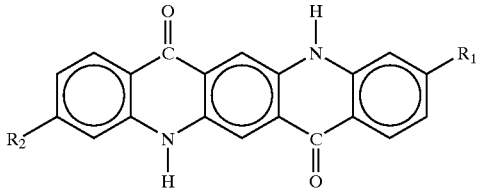

wherein at least one of $R_1$ and $R_2$ is a substituent $X_1$ represented by

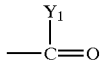

where $Y_1$ is an oligomer or a polymer, and the other is a hydrogen atom.

6. A process for producing a toner comprising preparing a polymerizable monomer composition containing at least a polymerizable monomer and a pigment, and polymerizing the polymerizable monomer in the composition to produce a toner;

said pigment having been surface-treated with a pigment dispersant having a structure represented by the following Formula (1), before said pigment is added to the polymerizable monomer composition:

(1)

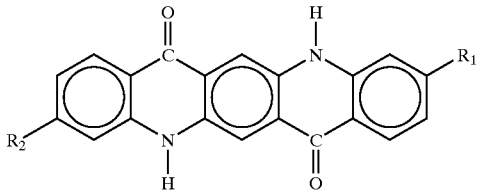

where at least one of $R_1$ and $R_2$ is a substituent $X_1$ represented by

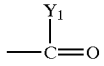

where $Y_1$ is an oligomer or a polymer, and the other is a hydrogen atom.

7. The process according to claim 6, wherein said toner is produced by suspension polymerization.

8. A process for producing a toner comprising preparing a polymerizable monomer composition containing at least a polymerizable monomer, a pigment and a pigment dispersant, and polymerizing the polymerizable monomer in the composition to produce a toner;

said pigment dispersant having a structure represented by the following Formula (1):

(1)

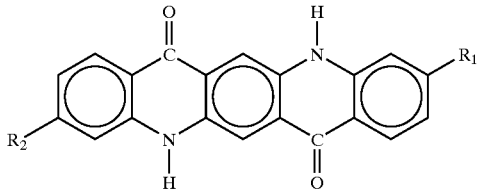

wherein at least one of $R_1$ and $R_2$ is a substituent $X_1$ represented by

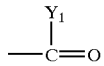

where $Y_1$ is an oligomer or a polymer, and the other is a hydrogen atom.

9. The process according to claim 8, wherein said toner is produced by suspension polymerization.

10. A toner comprising a binder resin, a pigment and a pigment dispersant;

said pigment dispersant having a structure represented by the following Formula (2):

(2)

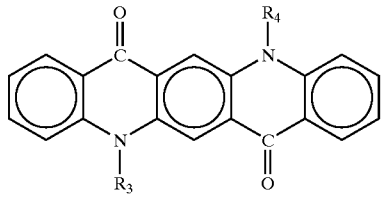

wherein at least one of $R_3$ and $R_4$ is a substituent $X_2$ represented by

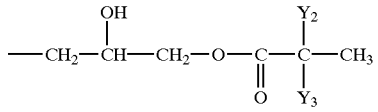

where $Y_2$ and $Y_3$ are each a substituent selected from the group consisting of H, $CH_3$, an oligomer and a polymer, and the other is a hydrogen atom.

11. The toner according to claim 10, wherein the substituents $Y_2$ and $Y_3$ of said pigment dispersant are each a vinyl polymer component containing as a monomer unit a monomer selected from the group consisting of styrene, a styrene derivative, acrylic or methacrylic acid and an acrylic or methacrylic acid ester, or a polyester component.

12. The toner according to claim 10, wherein said pigment dispersant is contained in an amount of from 2 parts by weight to 100 parts by weight based on 100 parts by weight of the pigment.

13. A process for producing a toner comprising melt-kneading a mixture containing at least a binder resin, a pigment and a pigment dispersant, and pulverizing the kneaded product obtained, followed by classification to produce a toner;

said pigment dispersant having a structure represented by the following Formula (2):

(2)

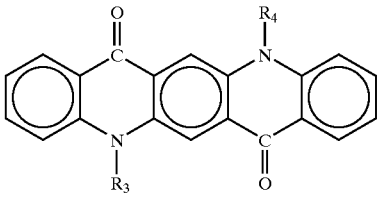

wherein at least one of $R_3$ and $R_4$ is a substituent $X_2$ represented by

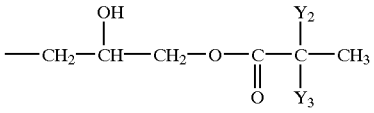

where $Y_2$ and $Y_3$ are each a substituent selected from the group consisting of H, $CH_3$, an oligomer and a polymer, and the other is a hydrogen atom.

14. A process for producing a toner comprising melt-kneading a mixture containing at least a binder resin and a pigment having been treated with a pigment dispersant, and pulverizing the kneaded product obtained, followed by classification to produce a toner;

said pigment dispersant having a structure represented by the following Formula (2):

(2)

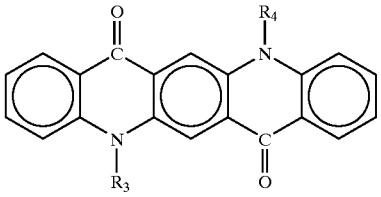

wherein at least one of $R_3$ and $R_4$ is a substituent $X_2$ represented by

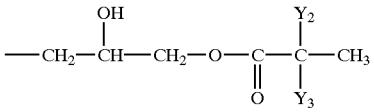

where $Y_2$ and $Y_3$ are each a substituent selected from the group consisting of H, $CH_3$, an oligomer and a polymer, and the other is a hydrogen atom.

15. A process for producing a toner comprising preparing a polymerizable monomer composition containing at least a polymerizable monomer and a pigment, and polymerizing the polymerizable monomer in the composition to produce a toner;

said pigment having been surface-treated with a pigment dispersant having a structure represented by the following Formula (2), before said pigment is added to the polymerizable monomer composition:

(2)

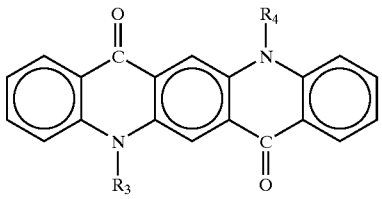

wherein at least one of $R_3$ and $R_4$ is a substituent $X_2$ represented by

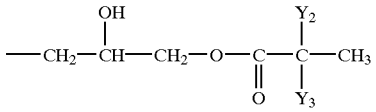

where $Y_2$ and $Y_3$ are each a substituent selected from the group consisting of H, $CH_3$, an oligomer and a polymer, and the other is a hydrogen atom.

16. The process according to claim 15, wherein said toner is produced by suspension polymerization.

17. A process for producing a toner comprising preparing a polymerizable monomer composition containing at least a polymerizable monomer, a pigment and a pigment dispersant, and polymerizing the polymerizable monomer in the composition to produce a toner;

said pigment having a structure represented by the following Formula (2):

(2)

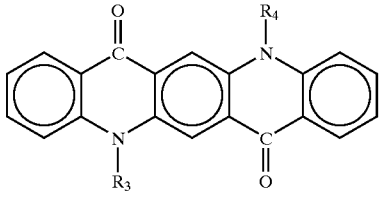

wherein at least one of $R_3$ and $R_4$ is a substituent $X_2$ represented by

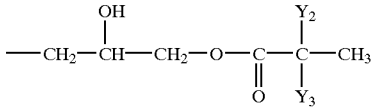

where $Y_2$ and $Y_3$ are each a substituent selected from the group consisting of H, $CH_3$, an oligomer and a polymer, and the other is a hydrogen atom.

18. The process according to claim 17, wherein said toner is produced by suspension polymerization.

* * * * *

UNITED STATES PATENT AND TRADEMARK OFFICE

CERTIFICATE OF CORRECTION

PATENT NO. : 6,500,593 B2 
DATED : December 31, 2002
INVENTOR(S) : Koji Abe et al.

It is certified that error appears in the above-identified patent and that said Letters Patent is hereby corrected as shown below:

Column 2,
Line 12, “particular” should read -- particular, --; and
Line 13, “are no” should read -- are so --.

Column 5,
Line 22, “p-ethylstyrenee,” should read -- p-ethylstyrene, --;
Line 39, “other;” should read -- ether; --; and
Line 48, “if” should read -- it --.

Column 6,
Line 3, “initiator.” should read -- initiators. --; and
Line 46, “may more preferably these” should read -- may more preferably be those metal oxides --.

Column 10,
Line 54, “Mw: 2,743).” should read -- Mw: 4,743). --.

Column 15,
Line 31, “-8.4” should read -- -18.4 --; and
Line 40, “humidly” should read -- humidity --.

Column 18,
Line 40, “-20°” should read -- -20.6 --; and
Line 54, “chrome” should read -- chroma --.

Column 20,
Line 52, “environment” should read -- environmental --.

UNITED STATES PATENT AND TRADEMARK OFFICE

CERTIFICATE OF CORRECTION

PATENT NO. : 6,500,593 B2 
DATED : December 31, 2002
INVENTOR(S) : Koji Abe et al.

It is certified that error appears in the above-identified patent and that said Letters Patent is hereby corrected as shown below:

Column 21,
Line 4, "(%) -" should read -- (%) = --.

Signed and Sealed this

Seventh Day of October, 2003

JAMES E. ROGAN
*Director of the United States Patent and Trademark Office*